US012729462B2

(12) United States Patent
Comotto

(10) Patent No.: US 12,729,462 B2
(45) Date of Patent: Sep. 8, 2026

(54) WEFT FEEDER FOR WEAVING LOOMS WITH SPACED THREAD COILS AND ADJUSTABLE-DIAMETER DRUM

(71) Applicant: ROJ S.R.L., Biella (IT)

(72) Inventor: Riccardo Comotto, Biella (IT)

(73) Assignee: ROJ S.R.L., Biella (IT)

( * ) Notice: Subject to any disclaimer, the term of this patent is extended or adjusted under 35 U.S.C. 154(b) by 0 days.

(21) Appl. No.: 19/378,579

(22) Filed: Nov. 4, 2025

(65) Prior Publication Data

US 2026/0125830 A1 May 7, 2026

(30) Foreign Application Priority Data

Nov. 7, 2024 (IT) ..... 102024000025050

(51) Int. Cl.
*D03D 47/34* (2006.01)
*D03D 47/36* (2006.01)
*D03D 47/00* (2006.01)

(52) U.S. Cl.
CPC ..... *D03D 47/361* (2013.01)

(58) Field of Classification Search
CPC ..... D03D 47/361
See application file for complete search history.

(56) References Cited

U.S. PATENT DOCUMENTS 4,850,400 A * 7/1989 Gorris ..... D03D 47/367 242/365.5
5,046,537 A * 9/1991 Maina ..... D03D 47/362 242/365.5

(Continued)

FOREIGN PATENT DOCUMENTS

CN 111788048 B * 3/2022 ..... B26B 21/225
EP 0930386 B1 12/2002

(Continued)

OTHER PUBLICATIONS https://mathmonks.com/prism/trapezoidal-prism; Trapezoidal Prism; Aug. 3, 2023 (Year: 2023).*

(Continued)

*Primary Examiner* — Robert H Muromoto, Jr.
(74) *Attorney, Agent, or Firm* — Chrisman Gallo Tochtrop LLC

(57) ABSTRACT

A weft feeder for weaving looms with spaced thread coils and adjustable-diameter drum formed of several fixed sectors, each provided with respective support shanks housed in respective seats formed in a static support disk, coaxial to a drive shaft of the weft feeder, and wherein the spacing of said spaced coils on the drum is caused by the oscillatory and tilting movement of several moving sectors, each provided with respective support shanks housed in respective seats formed in a tilting support disk, eccentric and skew with respect to said drive shaft of the weft feeder, and wherein elastic elements are provided, which exert a compressive force on said shanks to keep said fixed sectors and said moving sectors in a position of stable engagement within their respective seats. The fixed sectors and the moving sectors are each provided with a single support shank in the general shape of a trapezoidal right prism, housed in a respective seat consisting of a cavity having a congruent trapezoidal shape, and said elastic elements exert a compressive force on the major base of said support shank having the shape of a trapezoidal right prism.

11 Claims, 8 Drawing Sheets

(56) References Cited

U.S. PATENT DOCUMENTS

| | | | | | |
|---|---|---|---|---|---|
| 5,211,347 | A * | 5/1993 | Riva | D03D 47/367 | 242/366.4 |
| 5,577,536 | A * | 11/1996 | Maina | D03D 47/366 | 139/452 |
| 5,671,783 | A | 9/1997 | Zenoni et al. | | |
| 5,673,729 | A * | 10/1997 | Maina | D03D 47/366 | 139/452 |
| 5,678,779 | A * | 10/1997 | Maina | D03D 47/34 | 139/452 |
| 9,394,635 | B2 * | 7/2016 | Ballabio | D03D 47/362 | |
| 2013/0276933 | A1 * | 10/2013 | Ballabio | D03D 47/367 | 139/452 |

FOREIGN PATENT DOCUMENTS

| | | | |
|---|---|---|---|
| EP | 3567144 | A1 | 12/2019 |
| EP | 3631065 | B1 | 4/2020 |
| WO | 2015169612 | A1 | 11/2015 |
| WO | 2018219821 | A1 | 12/2018 |

OTHER PUBLICATIONS

A the search report issued in corresponding Italian patent application No. IT 102024000025050; Mailing Date: Apr. 25, 2025.

* cited by examiner

WEFT FEEDER FOR WEAVING LOOMS WITH SPACED THREAD COILS AND ADJUSTABLE-DIAMETER DRUM

FIELD OF THE INVENTION

The present invention relates to a new weft feeder for weaving looms with spaced thread coils, and in particular for air-jet and water-jet looms, which, in addition to the normal functions already offered by the currently available weft feeders of the known type, also allows a particularly quick adjustment of the drum diameter.

PRIOR STATE OF THE ART

As it is well known, weft feeders are weft thread feeding devices, interposed between the loom and the spools, which feeds the weft thread to the loom, by continuously accumulating it in successive spaced coils on a cylindrical drum, at as constant a speed as possible—in the clockwise or counterclockwise direction depending on the thread features—so as to create a reserve of weft thread which is subsequently extracted in the axial direction from the weft feeder drum at a variable speed—during the insertion of the weft thread in the shed—without thus causing tension peaks in the weft thread, which would undermine both the thread itself integrity and the fabric quality.

Weft feeders are devices which have been in common use for many years now in the weaving mills and, over the years, they have been enhanced with additional control functions, in addition to the basic functions mentioned above, which allow to check the weft thread constant presence at the weft feeder critical points, to adjust the amount of weft thread accumulated in the reserve and the mutual distance, or pitch, between the individual coils, to brake the outgoing weft thread in order to contain the dynamic effects caused by the sudden drawing-out acceleration, to measure the length of the weft thread section drawn-out by the insertion devices and, finally, to stop the weft thread drawn-out as soon as a predetermined length has been supplied.

The amount of weft thread accumulated in the reserve obviously depends on the weft feeder drum diameter on which such reserve is wound, and on the number of coils that can be simultaneously accommodated on said drum. To increase the adjustment range of a single weft feeder and make thus a single weft feeder suitable for use both on air-jet and water-jet looms even of very different heights, in addition to the possibility of varying the number of coils by modifying the pitch between successive coils, the possibility of modifying the drum diameter has also been introduced. Given, in fact, that the inserted weft length corresponds to an integer number of coils, a variation of the drum diameter allows for fine adjustment of such length as there is a single stopping point for the weft thread exiting the weft feeder drum. To this end, the drum is normally formed of several fixed sectors—usually four—each independently fixed to the weft feeder body. In the case of adjustable-diameter drums, the fixed sectors are fixed to the weft feeder body in an adjustable radial position and then clamped in the desired position by means of locking screws.

To automate and speed up this adjustment process, WO2015/169612 discloses a weft feeder provided with a non-reversible gear system, operated by a servo control. This system allows the radial position of three adjustable sectors of the weft feeder to be simultaneously adjusted, while also ensuring that they are locked in the desired adjustment position without the use of locking screws, thanks to the non-reversibility of the gear system. Each adjustable sector is provided with two support shanks, either parallel or slightly converging, and the gear system cooperates with only one of said shanks, which due to this reason is provided with a rack portion, while the other shank slides inside a respective guide to improve the stability of the adjustable sector. The fourth sector has an invariable position, as the presence of the weft thread is optically detected thereon and therefore, for greater simplicity of construction, it was decided to always keep such sector at a fixed distance from the weft feeder arm, parallel to the same, on which arm the optical sensors detecting the weft thread are installed.

In the type of weft feeders provided with a device for spacing at a predetermined pitch the individual coils wound on the drum—commonly referred to as weft feeders with spaced coils—it is further provided a corresponding number of moving sectors mounted on a stationary tilting flange which is in turn supported, through the interposition of a ball bearing, by the external surface of a bushing keyed to an eccentric portion of the weft feeder shaft; said bushing is furthermore provided with an external cylindrical surface inclined by a few degrees with respect to the drum surface. Thanks to this arrangement, during the weft feeder shaft rotation, the inclined bushing rotates integrally with said shaft and with the bearing internal ring, causing a combined periodic oscillation of the bearing itself and therefore of the tilting flange which is integral with the bearing external ring. The oscillation of said tilting flange is transmitted to the moving sectors, and in particular to their taking fingers which thus cyclically protrude from the drum fixed sectors, with a complex movement consisting of a combination of an oscillatory movement in the radial direction, caused by the eccentric portion of the weft feeder shaft, and a tilting movement, caused by the rotation of the inclined bushing. This complex movement of the taking fingers of the moving sectors allows therefore for the progressive movement of the coils wound on the drum at a constant pitch—adjustable at will, based on the inclination of the bushing external surface—in the direction of the area where the weft thread exits the drum.

In weft feeders with spaced coils for air-jet and water-jet looms, to which this invention is addressed, the operation of varying the drum diameter involves not only unlocking/locking the drum fixed sectors, but also unlocking/locking the moving sectors mounted on the eccentric and inclined bushing. Such moving sectors, in fact, must obviously be repositioned according to the new radial position taken by the fixed sectors forming the drum. It is therefore a quite long operation, which requires the direct intervention of a specialized operator on the weft feeder to loosen the locking screws of the four fixed sectors and the four moving sectors, then move all such sectors to their new desired radial position and, finally, tighten again all the aforementioned locking screws.

The solution disclosed in WO2015/169612 and discussed above is unsatisfactory for this purpose because the adopted mechanical construction is rather cumbersome and, furthermore, is still subject to a certain position uncertainty caused by the gear system play, lacking of locking screws against fixed stops—only partially limited by the presence of preload springs or friction elements of the support shanks of the adjustable sectors in their respective seats—and activated by the vibrations of the weft feeder during loom operation. Furthermore, when the position of the three adjustable sectors is modified, the undesirable consequence is that the drum shape, which is overall determined by the fixed sector and the three adjustable sectors, is no longer perfectly circular, since the solution disclosed by this patent necessarily requires, as mentioned above, at least one of the drum sectors to have a constant position. The operation of the taking fingers of the moving sectors would thus be much less regular and effective.

U.S. Pat. No. 5,671,783 discloses a weft feeder with spaced coils wherein the radial position of the four fixed sectors can be modified by means of a respective radial displacement mechanism including at least one main drive gear cooperating with individual secondary gears which, in turn, cause the radial movement of respective sectors of the drum, via lead screw couplings. A similar mechanism is provided to adjust the radial position of the four moving sectors. Each sector is supported by a single, threaded shank having a circular cross-section, which, however, does not allow to determine a precise and stable angular position of the sector itself. Furthermore, the aforementioned radial displacement mechanisms are not provided with locking screws and therefore only rely on the non-reversible threaded couplings of the fixed and moving sectors to the respective displacement mechanisms to maintain the weft feeder in stable working positions. The solution disclosed in U.S. Pat. No. 5,671,783 is therefore not entirely satisfactory because it is subject to somewhat uncertain working positions, as already mentioned above, due to the single, screw support shank of the sectors, the play of the gears, and the system vibrations.

EP-3631065 discloses a weft feeder with spaced coils which replicates the configuration disclosed in WO2015/169612, namely, three adjustable sectors and one fixed sector, improving its adjustment method by introducing in the adjustable sectors a central shaft having a rectangular cross-section. The radial position of each sector is, in fact, modified by the cooperation between a disk with spiral ribs on one of its faces and complementary ribs formed on an opposing face of the aforementioned central shaft. The adjustable sectors are thus provided with a total of three shafts—two lateral guide-shafts with a circular cross-section and a central shaft with a rectangular cross-section—for adjusting their radial position. A similar structure is provided for adjusting the radial position of the moving sectors which cause the spacing between the coils wound on the weft feeder, the respective disk with spiral-shaped ribs being opposed and integral with the similar disk of the fixed sectors, so that the two disks can be moved in rotation by a same actuator, allowing the simultaneous adjustment of the radial position of both the fixed sectors and the moving sectors.

The same document EP-3631065 also discloses a play adjustment system which operates on one of the lateral shanks of the adjustable sectors and includes an elastic preload element which limits the play between the shank and its seat, through a dedicated actuator which exerts an adjustable pressure on said shank, between a release position wherein the elastic pressure is sufficient to eliminate the play while allowing the longitudinal sliding of the shank when adjusting the shank position, and a locking position wherein the shank is locked in a desired adjustment position.

EP-3567144, on behalf of the same Applicant, proposes an innovative solution wherein the unlocking/locking of the weft feeder fixed sectors and moving sectors is carried out simultaneously by a single first servo control, while a second servo control allows the simultaneous fine adjustment of the position of the fixed sectors and the moving sectors, and therefore of the drum diameter, even during the loom operation.

Both the last two solutions described above have proven effective in allowing quick and simultaneous adjustment of the position of the fixed sectors and the moving sectors of a weft feeder with spaced coils, although, for EP-3631065, this is limited to only three of the four sectors. However, these are particularly complex and sophisticated, and therefore expensive, solutions which can only find commercial application in the production of high-quality fabrics.

It remains therefore unsatisfied the very-widespread-in-the-textile-field demand for a weft feeder with spaced coils for air-jet and water-jet looms, which allows for a quick and effective adjustment of the entire drum diameter, i.e., simultaneously of all the fixed and moving sectors forming the same, and yet have manufacturing costs not significantly higher than the weft feeders of the same type currently present on the market, wherein the adjustment must be carried out separately for the fixed and the moving sectors.

The technical problem addressed by the present invention is therefore precisely that of offering a weft feeder with spaced coils having a drum with a diameter which is fully adjustable in a single operation, which allows for a drastic reduction in the time required for the operation of adjusting the drum diameter, by means of a simple mechanical solution, which therefore does not entail a significant increase in its manufacturing costs.

In the context of this technical problem and considering that current systems for adjusting a weft feeder drum diameter already allow for simultaneous adjustment of the position of the fixed sectors and the moving sectors, a first object of the invention is to simplify the support structure of the fixed and moving sectors, while maintaining a high level of positional stability of the same in an adjusted position.

A second object of the invention is to drastically reduce the time of unlocking/locking of said fixed sectors and moving sectors of the weft feeder.

Finally, a third object of the invention is to control the plays of the device for adjusting the position of the fixed sectors and the moving sectors, in order to prevent such plays from being distributed randomly when the fixed and the moving sectors are unlocked before the adjustment of the drum diameter, and thus obtain a precise and repeatable adjustment of the drum diameter already at the first adjustment attempt, without the need to carry out iterative adjustments until the plays are completely recovered.

SUMMARY OF THE INVENTION

This problem is solved and these objects achieved by a weft feeder for weaving looms with spaced thread coils and quick adjustment of the drum diameter, having the features defined in independent claim 1. Other preferred features of such a weft feeder with quick adjustment of the drum diameter are defined in the secondary claims.

BRIEF DESCRIPTION OF THE DRAWINGS

Further features and advantages of the weft feeder for weaving looms with spaced thread coils and quick adjustment of the drum diameter, according to the present invention will anyhow become more evident from the following detailed description of a preferred embodiment of the same, given by mere way of non-limiting example and illustrated in the accompanying drawings, wherein.

DETAILED DESCRIPTION OF THE PREFERRED EMBODIMENT

Figure 1:
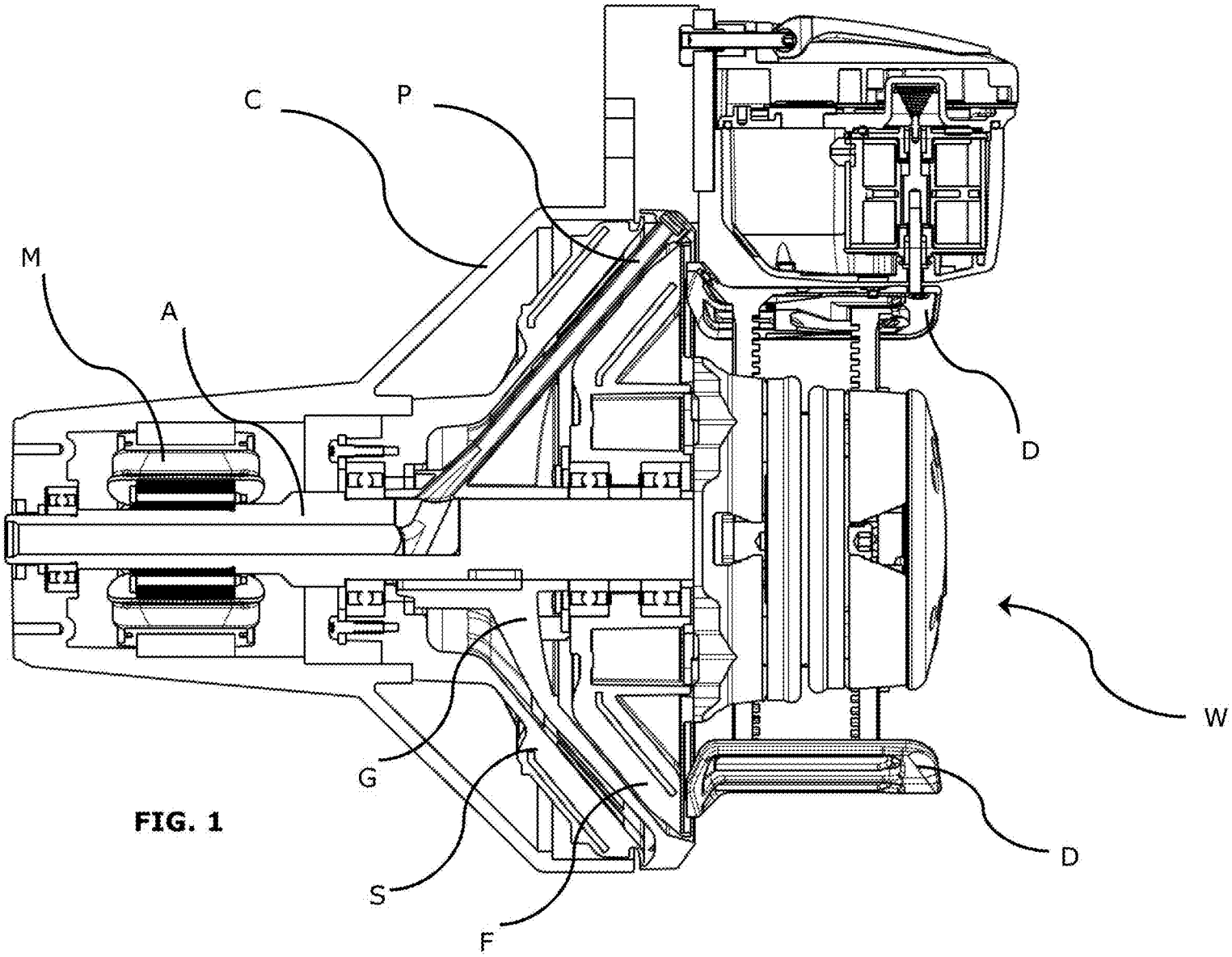
FIG. 1 is an axial sectional view of a weft feeder incorporating the device of the present invention for the quick adjustment of the drum diameter.

According to the present invention, in order to solve the above-mentioned problem by means of a constructively much simpler—yet still equally effective—solution than the prior art constructions illustrated above, the fixed and moving sectors are all provided with a single central support shank generally shaped like a trapezoidal right prism, preferably having an isosceles trapezoidal cross-section. Thanks to this shape, the engagement of the support shank with a respective seat consisting of a cavity of congruent shape—which may also be partially open, i.e., substantially limited to the converging side walls of the support shank—causes the support shank to self-centre and lock when pushed into its respective seat with an adequate compressive force exerted against the major base of its trapezoidal prism shape. Thanks to this special configuration, the single shank of each of the fixed sectors and the moving sectors can perform both the function of taking up any mechanical plays and that of regulating the radial position of the sectors, which functions were instead entrusted to different support shanks for each one of the fixed and moving sectors, in the prior art.

In a first embodiment of the invention, the weft feeder diameter is adjusted without the need to unlock the fixed and moving sectors; as a matter of fact, it is sufficient to directly act on the adjustment group to change the weft feeder drum diameter. To achieve this result, the individual support shanks of the moving and fixed sectors are no longer locked in place by respective fixing screws, but they are stably held in the desired operating position within their respective trapezoidal seats thanks to the compressive force exerted thereon by suitable elastic elements. Thanks to the trapezoidal shape of the sector support shank, in fact, the force exerted by said elastic elements on the major base of the trapezoidal shape causes a friction force—which develops between the converging side walls of the support shank and the corresponding walls of the respective seat—which is sufficient to maintain the sectors in the set adjustment position, even in the presence of stresses imparted by the thread wound on the weft feeder drum, or by vibrations caused by variable accelerations of the weft feeder motor. However, such friction force is still low enough to allow the support shanks of the sectors to be radially translated with respect to the weft feeder shaft, i.e., in the longitudinal direction of the shanks, following a driving action given by the adjustment group, thus allowing the drum diameter to be adjusted directly, i.e., without the need for a preliminary operation to unlock the fixed sectors and the moving sectors.

Since it no longer entails the operation of unlocking the sectors, this solution also prevents a free redistribution of the plays—as it conversely occurs in the weft feeders of the known type with locking screws—since the plays remain constantly locked in a specific mating position, precisely thanks to the presence of said elastic elements. This condition allows therefore for not only faster but also more precise adjustment of the weft feeder drum diameter, limiting the number of fine adjustments needed to stably achieve a desired weft feeder drum diameter, and thereby ensuring excellent repeatability in the positioning of the fixed sectors and the moving sectors in subsequent weaving operations.

In a second embodiment of the invention—which finds its specific field of application in all those weaving operations wherein the stresses imparted by the thread or by the accelerations of the weft feeder motor are particularly high and therefore cannot be entirely counteracted by the elastic elements alone described in the first embodiment—the action of said elastic elements is supplemented by quick-tensioning fasteners, bistable between a locked position and an unlocked position, which can be simultaneously and quickly loosened, thus reducing the overall times for preparation and rearrangement of the weft feeder before and after diameter adjustment to negligible values of a few tens of seconds. It is thus possible to carry out these problematic weaving operations without sacrificing the convenience of a direct adjustment of the weft feeder drum diameter in all other weaving operations, wherein the quick-tensioning fasteners remain therefore deactivated.

General Construction of a Weft Feeder with Spaced Coils

As is well known to those skilled in the art, a weft feeder with spaced coils, schematically illustrated in cross-section in FIG. 1, includes as its main parts a base body C, wherein an electric motor M is housed which rotates a hollow shaft A. The shaft A drives into rotation with its middle portion a cup-shaped coiler G, and supports on bearings with its end portion a stationary winding group W. The coiler G rotates within a cavity formed between two cup-shaped elements provided with permanent magnets, namely a static magnet-cup S, integral with the base body C, and a floating magnet-cup F with which, on the side opposite to said magnets, the stationary winding group W is integral. The magnets of the magnet-cups S and F are arranged in such a way as to cause a strong mutual attraction between the two magnet-cups, which attraction is sufficient to keep the position of the winding group W stationary to rotation, despite the absence of any mechanical connection with the base body C and despite the rotating dragging action exerted by the shaft A on the winding group W.

The weft thread coming from a supply spool (not illustrated) is axially inserted into the shaft A of the weft feeder from its rear end, and exits from an exit opening formed on the periphery of the coiler G, through an inner channel P of said coiler G which is in connection with the axial cavity of the shaft A. When the coiler G is rotated, the thread taken from the spool is arranged in successive coils on an external drum D of the winding group W.

Figure 2:
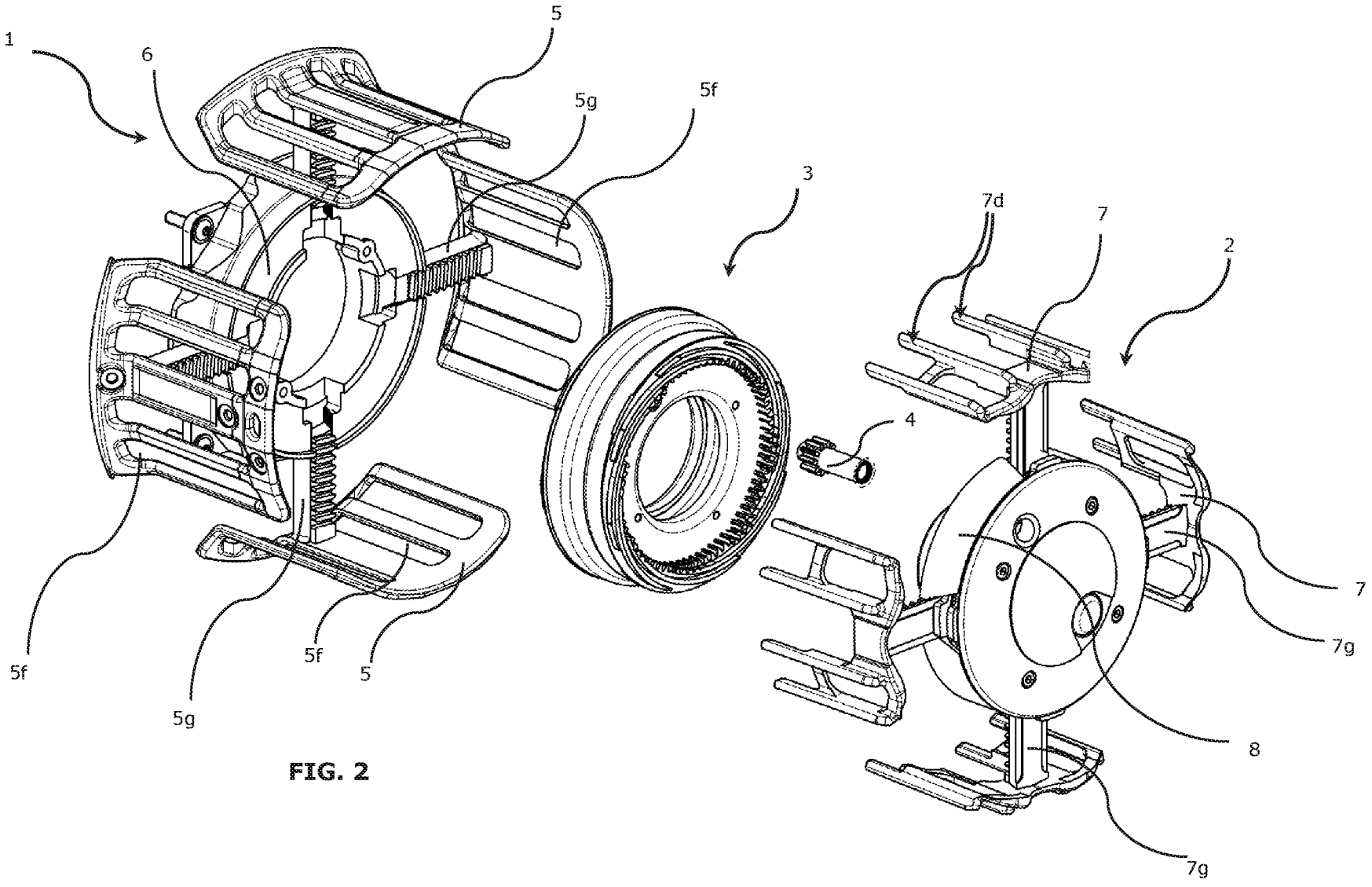
FIG. 2 is an exploded view of the winding area of the weft feeder of FIG. 1, which includes a static body, a tilting body and an adjustment group connecting them together, in a first embodiment of the invention.

As illustrated in the exploded view of FIG. 2, the winding group W includes a static body 1 integral with the floating cup F, a tilting body 2 and an adjustment group 3, interposed between the static body 1 and the tilting body 2. The tilting body 2 is directly supported by the shaft A in correspondence with an eccentric bushing keyed onto said shaft, the external surface of which is furthermore provided with a moderate inclination of a few degrees with respect to the axis of the shaft A.

The static body 1 forms the weft feeder drum D on which the weft thread reserve is wound, and is formed of several—preferably at least four—independent fixed sectors 5 having an arched surface, each of which is provided with a single respective shank 5*g* through which is fixed to a static support disk 6, which in turn is stably anchored to the floating magnet-cup F. The static support disk 6 contains radial seats for the shanks 5*g* of the fixed sectors 5, inside which said shanks 5*g* can longitudinally slide in a radial direction to determine different working positions of the fixed sectors 5 during the weft feeder operation with different weaving heights.

First Embodiment of the Invention

According to a first important feature of the invention, the shanks 5*g* side walls converge, preferably symmetrically, so that the shanks 5*g* have a trapezoidal, and preferably an isosceles trapezoidal, cross-section and, overall, the shanks have the general shape of a trapezoidal right prism. The radial seats of the shanks 5*g* consist of cavities of a congruent shape—if useful, also partially open at the major base and/or minor base of the trapezoidal shape—so as to cause, by mating the converging sides of the respective trapezoidal shapes, the automatic centering of the shanks 5*g* and their locking in a stable position when said shanks 5*g* are held pressed against their respective seats by an elastic force.

Except for the shape of the respective moving sectors 7, the tilting body 2 structure is completely similar to that described above for the static body 1 and it therefore includes said moving sectors 7, each of which is provided with a respective shank 7*g* to be fixed to a tilting support disk 8, which in turn is stably constrained, free to rotate, on the free end of the weft feeder shaft A in correspondence with the above-said eccentric bushing. The tilting support disk 8 contains radial seats for the shanks 7*g* of the moving sectors 7, inside which said shanks 7*g* can longitudinally slide in a radial direction to determine different working positions of the moving sectors 7 during the weft feeder operation with different weaving heights. The shanks 7*g* of the moving sectors 7 are also in the shape of trapezoidal right prisms and therefore have a trapezoidal, and preferably an isosceles trapezoidal, cross-section and are housed in congruently shaped seats which are also partially open at one and/or the other of the two opposing bases, if necessary. The shanks 7*g* of the moving sectors 7 are positioned in a mirror-like manner with respect to the shanks 5*g* of the fixed sectors 5; as a matter of fact, both shanks 5*g* and shanks 7*g* are facing the single adjustment group 3 with their minor bases provided with guide ribs.

When the static body 1 and the tilting body 2 are mutually mounted in the weft feeder, the fingers 7*d* of the moving sectors 7 are housed in correspondence with large windows 5*f* of the fixed sectors 5 through which the fingers 7*d* cyclically protrude, during the oscillatory and tilting movement of the tilting body 2, thus causing the lifting and progressive advancement of the weft thread coils wound onto the drum D.

As is well known, the radial position of the fixed sectors 5 and the moving sectors 7 can be adjusted as desired, in order to modify the drum diameter D and thus vary the total length of weft thread accumulated on the drum D itself, while simultaneously maintaining the mutual positioning between said fixed sectors 5 and moving sectors 7 unchanged, as is essential for a correct functioning of the weft feeder moving sectors. This simultaneous adjustment is effectively carried out, in a manner known per se, by manually acting on the pinion 4 of the adjustment group 3, the shape and operation of which—which is however well-known and does not form part of the present invention—will be explained in more detail below.

In the weft feeder structure described above, a second innovation characterizes the first embodiment of the invention and concerns a device for locking the shanks 5*g* and 7*g* in the desired working position, determined from time to time by means of the adjustment group 3.

Figure 3:
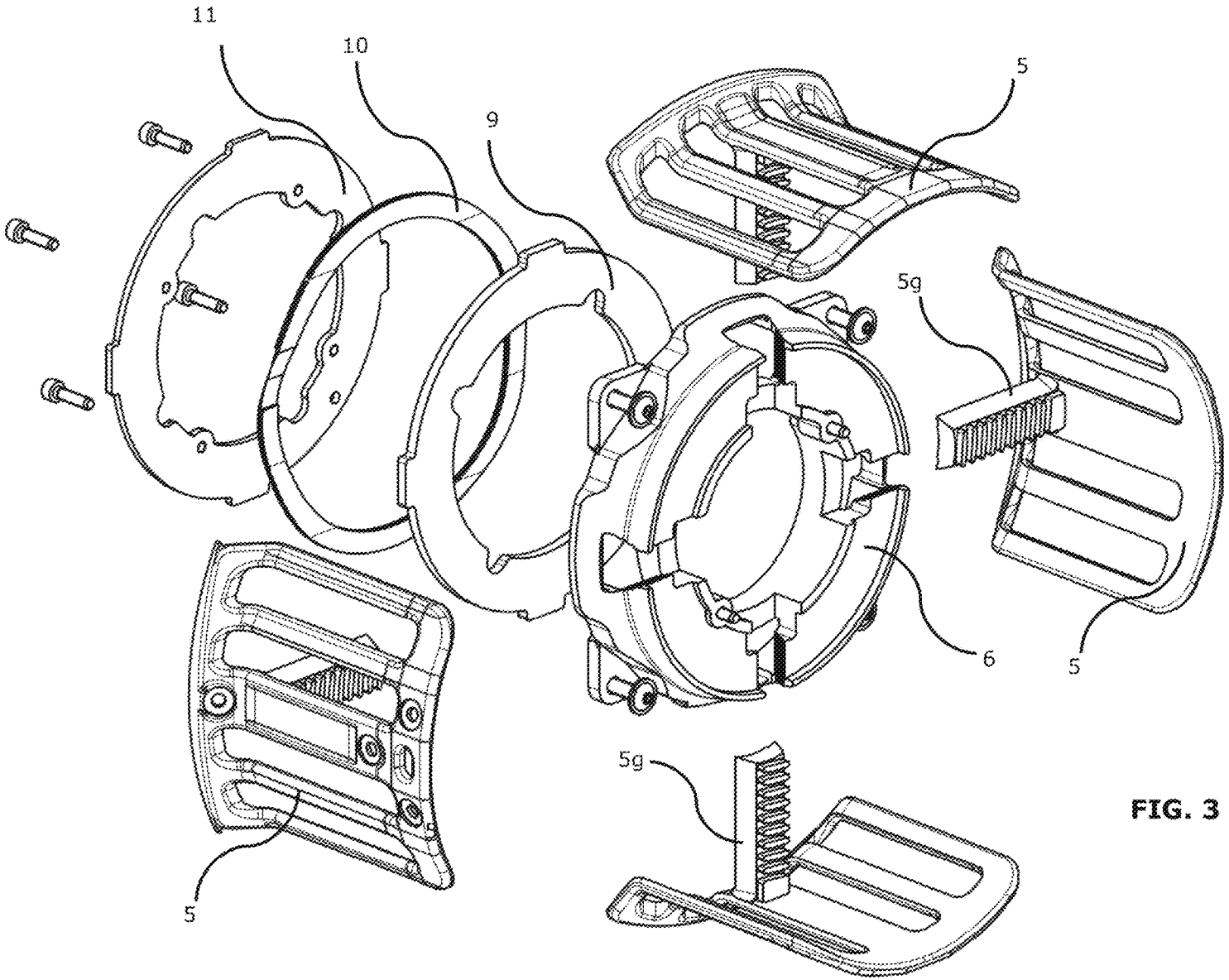
FIG. 3 is an exploded view of only the static body of FIG. 2, including four fixed sectors which form the weft feeder drum.

According to the invention, in fact, and as illustrated in detail in FIG. 3, the shanks 5*g* of the fixed sectors 5 are kept pressed against their respective trapezoidal cross-section seats by an elastic element preferably having the shape of a static spring 10, such as a wave spring or a cup spring. Preferably, the static spring 10 does not act on the shanks 5*g* directly but through the interposition of a flat and rigid static "shank-pressing" ring 9, which is pressed by the static spring 10 with a compressive force predetermined by a static closing ring 11 of the static body 1, mounted at a predetermined distance from the static shank-pressing ring 9, so as to cause a desired preload of the static spring 10. The preload extent of the static spring 10 is optimised so that the compressive force exerted by the static spring 10 is sufficiently high to keep the shanks 5*g* in a stable locking position during the weft feeder normal operation. However, such locking force is still low enough to allow the position of said shanks 5*g* to be adjusted without the need to reduce the preload of the static spring 10. In particular, said compressive force is greater than the minimum clamping force required to keep the adjustment position of the shanks 5*g* unchanged during the weft feeder normal operation, and is less than the maximum clamping force required to still allow said shanks 5*g* to slide within their respective seats during adjustment of the position of said fixed sectors 5 by operating the adjustment group 3.

The static shank-pressing ring 9 is preferably made of a low-friction metallic material and is used to evenly distribute across all four shanks 5*g* the compressive force developed by the static spring 10, and to allow smooth radial sliding of the shanks 5*g* during the adjustment steps of the drum diameter D. As already mentioned above, the shanks 5*g* have an isosceles trapezoidal cross-section and are housed in respective seats consisting of cavities having a congruent configuration, so that a suitable compressive force exerted by the static spring 10 against the side of said shanks 5*g*, corresponding to the major base of their trapezoidal cross-section—i.e. the side facing the weft feeder body—develops a wedge-like effect in the coupling between each shank 5*g* and its respective seat, which makes such coupling perfectly stable even in the presence of stresses applied to the fixed sectors 5 which tend to modify their radial position.

Figure 4:
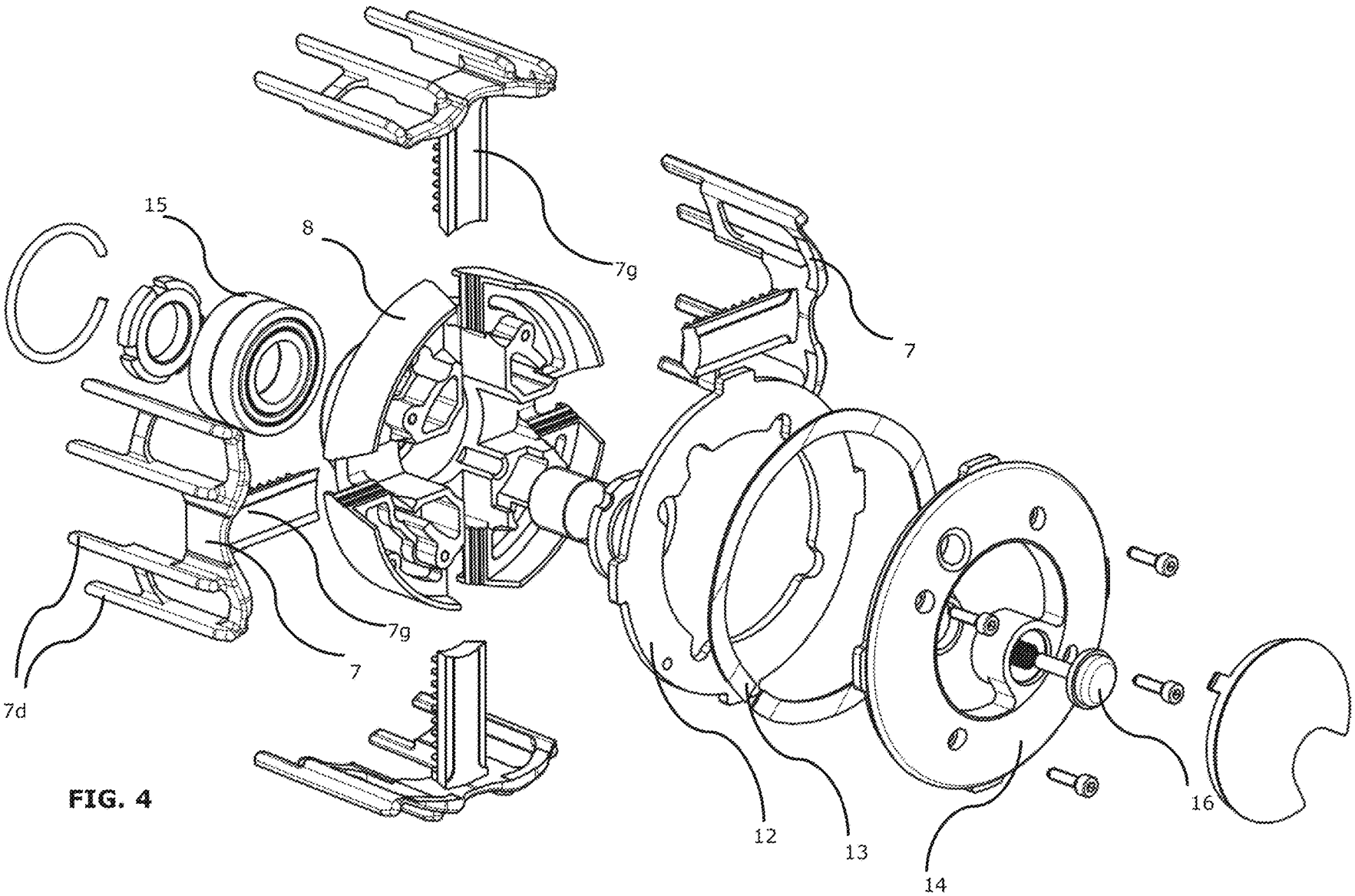
FIG. 4 is an exploded view of only the tilting body of FIG. 2 including the four moving sectors which cause the spacing between the weft thread coils wound on the weft feeder drum.

A completely similar construction is provided for the tilting body 2 and illustrated in detail in FIG. 4. As a matter of fact, also in the tilting body 2 the shanks 7*g* of the moving sectors 7 are kept pressed against their respective seats by a tilting spring 13, such as a wave spring or a cup spring. Preferably, the tilting spring 13 does not act on the shanks 7*g* directly but through the interposition of a flat and rigid tilting "shank-pressing" ring 12, which is pressed by the tilting spring 13 with a compressive force predetermined by a tilting closing ring 14 of the tilting body 2, mounted at a predetermined distance from the tilting shank-pressing ring 12, so as to cause a desired preload of the tilting spring 13. Also in the tilting body 2, the preload extent of the tilting spring 13 is optimised so that the compressive force exerted by said spring is sufficient to keep the shanks 7*g* in a stable position during the weft feeder normal operation, meanwhile allowing the position of the respective shanks 7*g* to be adjusted without the need to reduce the preload of the tilting spring 13. In particular, said compressive force is greater than the minimum clamping force required to keep the adjustment position of the shanks 7*g* unchanged during the weft feeder normal operation, and is less than the maximum clamping force required to still allow said shanks 7*g* to slide within their respective seats during adjustment of the position of said moving sectors 7.

All other technical features and operation of the tilting body 2 are identical to those described above in relation to the static body 1 and are not repeated here, for the sake of brevity. FIG. 4 also illustrates some other elements, well known per se, namely: a rolling bearing 15 which supports the tilting body 2 on the weft feeder hollow shaft A; and a "reverse" button 16 which activates the mechanism for adjusting the pitch of the coils and/or inverts the direction of rotation of the weft feeder.

Construction of the Adjustment Group—Known Art

Figure 5:
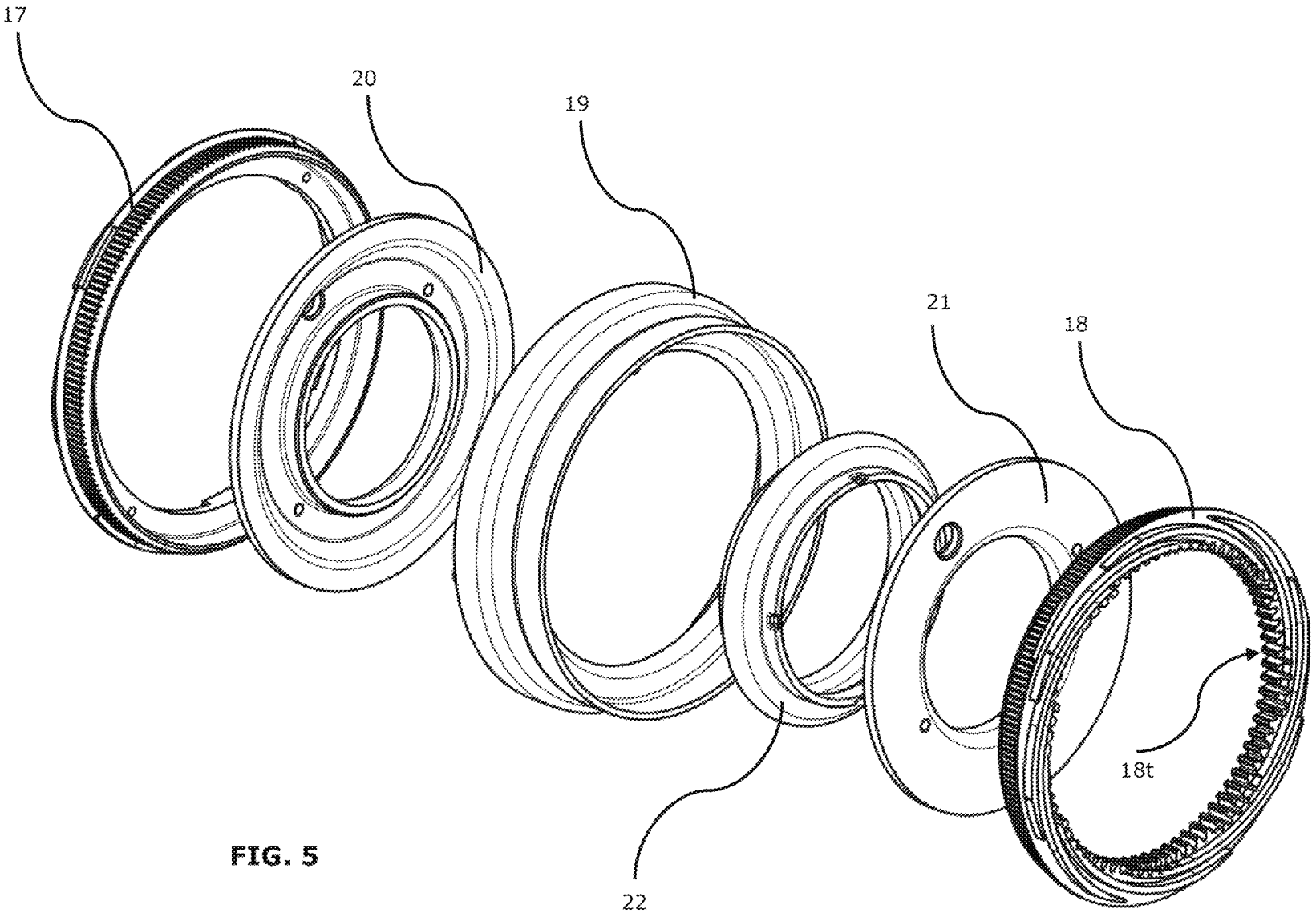
FIG. 5 is an exploded view of the adjustment group of FIG. 2 which allows the simultaneous adjustment of the radial position of the fixed sectors and the moving sectors of the weft feeder.

As already mentioned above, the static body 1 and the tilting body 2 are mutually connected by the adjustment group 3. The structure and operation of such adjustment group are already known per se and are therefore briefly described here, with reference to FIG. 5, only to allow a complete understanding of the weft feeder operation.

The adjustment group 3 then performs the following functions:

- connecting the tilting body 2 to the static body 1 in a semi-rigid way, that is, maintaining the correct mutual position of the fixed sectors 5 and the moving sectors 7 while leaving, meanwhile, the tilting body 2 free to perform the tilting movement caused by the eccentric and inclined bushing, which allows the progressive advancement of the weft thread coils on the weft feeder drum D;
- allowing the drum diameter D adjustment by synchronising the radial movement of the fixed sectors 5 and the moving sectors 7;
- maintaining correct positioning of its adjustment toothed rings so that they always remain correctly engaged with the corresponding teeth provided on the shanks 5*g* of the fixed sectors 5 and on the shanks 7*g* of the moving sectors 7.

The adjustment group 3 includes the following components, which structure and function are illustrated below:

- a static adjustment ring 17 for adjusting the position of the fixed sectors 5 and a tilting adjustment ring 18 for adjusting the position of the moving sectors 7. The static adjustment ring 17 and the tilting adjustment ring 18 are rigid rings which, when set in synchronous rotation, act with their lateral spiral rib on the toothed shanks 5*g* and 7*g* causing said shanks to slide in a radial direction. The tilting adjustment ring 18 is further provided with an internal toothing 18t on which the adjustment pinion 4 meshes, to control its rotation in both directions. The static adjustment ring 17, on the contrary, is not directly controlled and is driven into rotation by the tilting adjustment ring 18, integral therewith;
- a rubber external sleeve 19. On the one hand, said external sleeve 19 makes the static adjustment rings 17 and the tilting adjustment ring 18 integral with each other, by coupling its own cylindrical side portions with the knurled external surface of said adjustment rings, ensuring their synchronous movement during drum diameter adjustment. On the other hand, by means of its central bellows portion, the external sleeve 19 allows the continuous tilting movement of the tilting body 2 with respect to the static body 1 during the weft feeder operation;
- a static disk-guide 20, on the static body 1 side, consisting of a plate integrally mounted on the static support disk 6 of the fixed sectors 5, which keeps the spiral rib of the static adjustment ring 17 constantly meshing with the teeth of the shanks 5*g* of the fixed sectors 5;
- a tilting disk-guide 21, on the tilting body 2 side, consisting of a plate integrally mounted on the tilting support disk 8 of the moving sectors 7, which keeps the spiral rib of the tilting adjustment ring 18 constantly meshing with the teeth of the shanks 7*g* of the moving sectors 7;
- a rubber internal sleeve 22, also provided with cylindrical side portions and a central bellows portion. The cylindrical side portions make the two static and tilting disk-guides 20 and 21 and, consequently, the two static and tilting support disks 6 and 8, respectively of the fixed sectors 5 and the moving sectors 7, integral with each other. The function of the internal sleeve 22 is therefore to prevent relative rotation between the static body 1 and the tilting body 2, meanwhile allowing, thanks to the central bellows portion, the tilting motion of the tilting body 2, as necessary for a correct operation of the group.

Second Embodiment of the Invention

As already stated in the introductory part of the present disclosure, the second embodiment of the invention is aimed at increasing the compressive force exerted by the elastic elements on the shanks of the fixed and moving sectors in order to allow operations which impose particularly high stresses on said sectors, by means of locking devices characterised by very short activation/deactivation times to carry out the operations of locking/unlocking the fixed sectors 5 and the moving sectors 7. According to a third feature of the invention, said locking devices are of the quick-tensioning type, with bistable operation between a locked position and an unlocked position, and are used in addition to the elastic elements described in relation to the first embodiment of the invention, for the purpose of modifying their compressive force.

Figure 6:
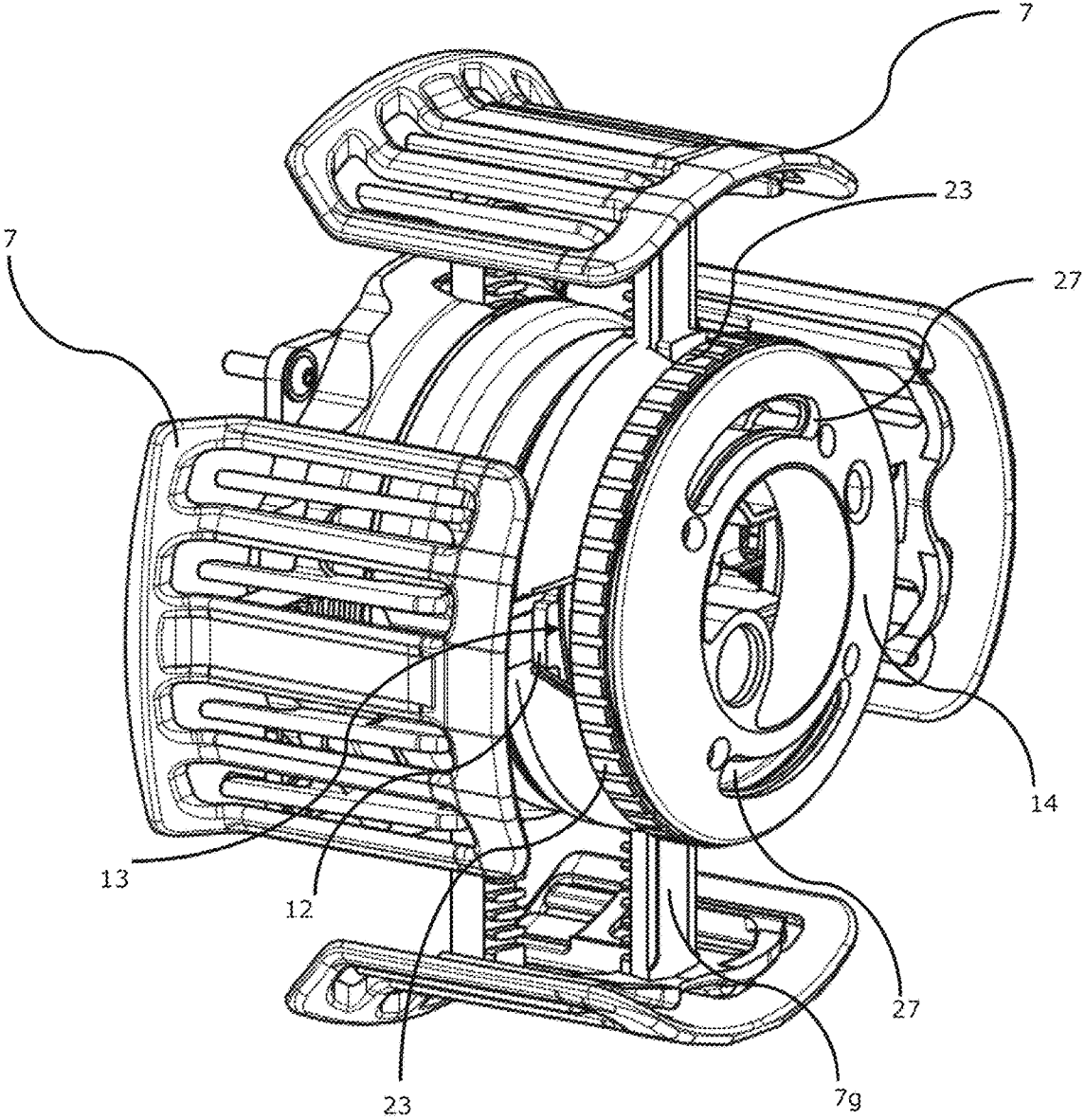
FIG. 6 is a perspective view of the assembled winding area of the weft feeder, in a second embodiment of the invention.
Figure 7A:
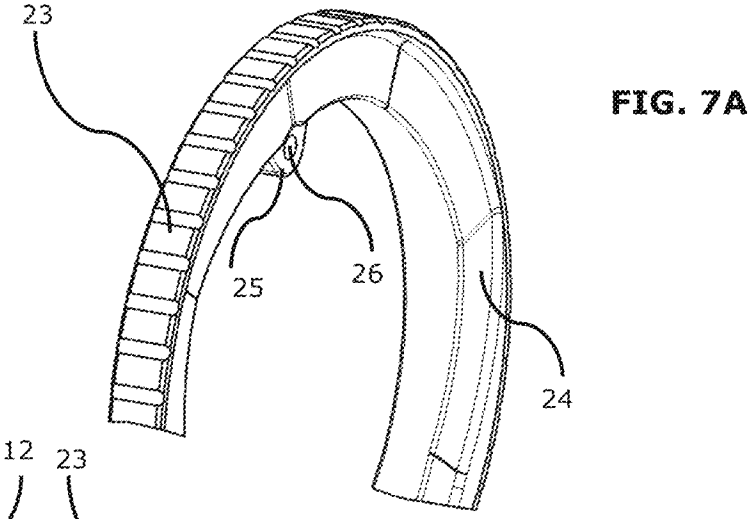
FIG. 7A is an enlarged partial view of the tilting locking ring of FIG. 7.
Figure 7:
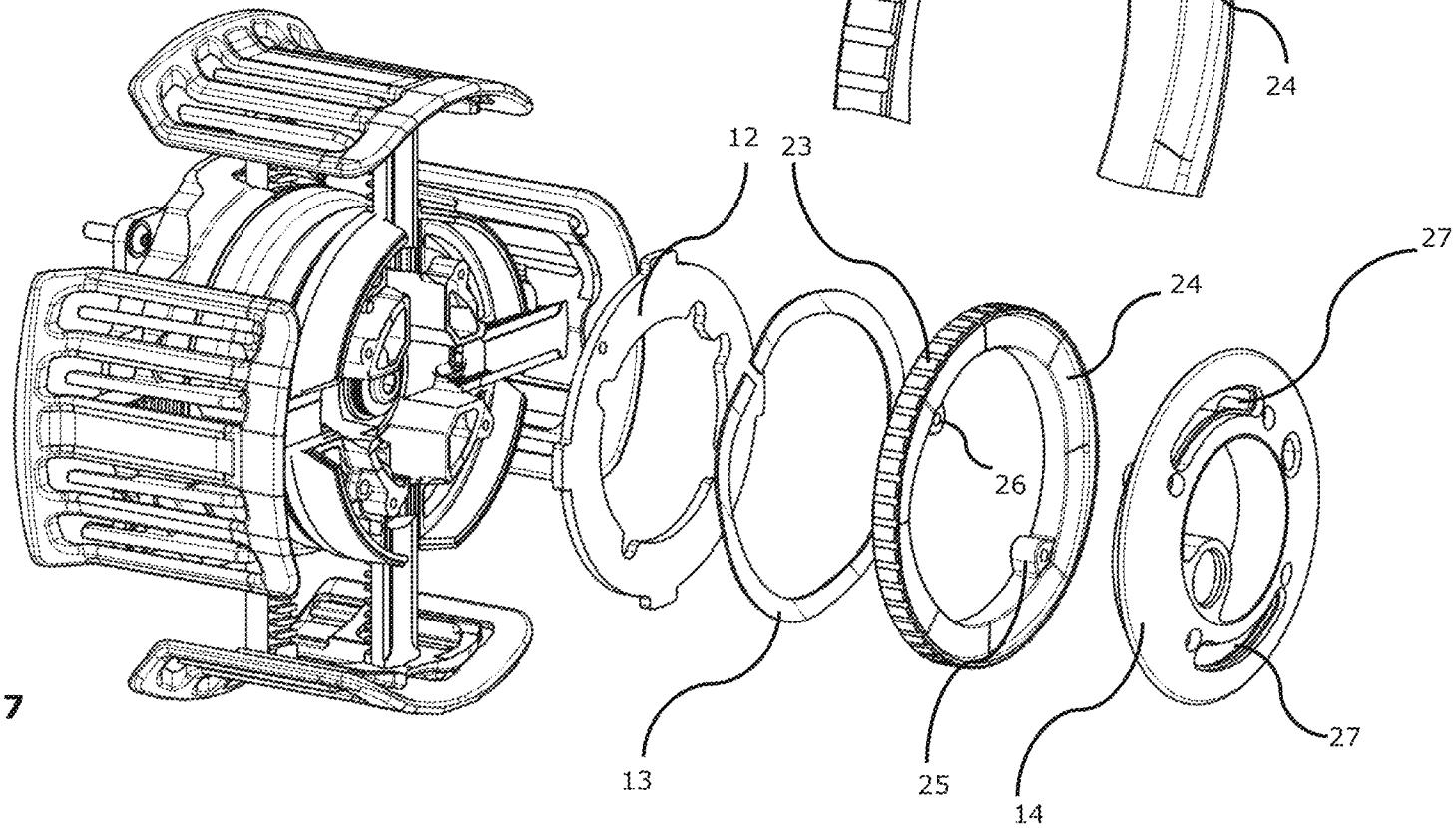
FIG. 7 is a perspective view of the same winding area of the weft feeder as in FIG. 6, with exploded parts.
Figure 8:
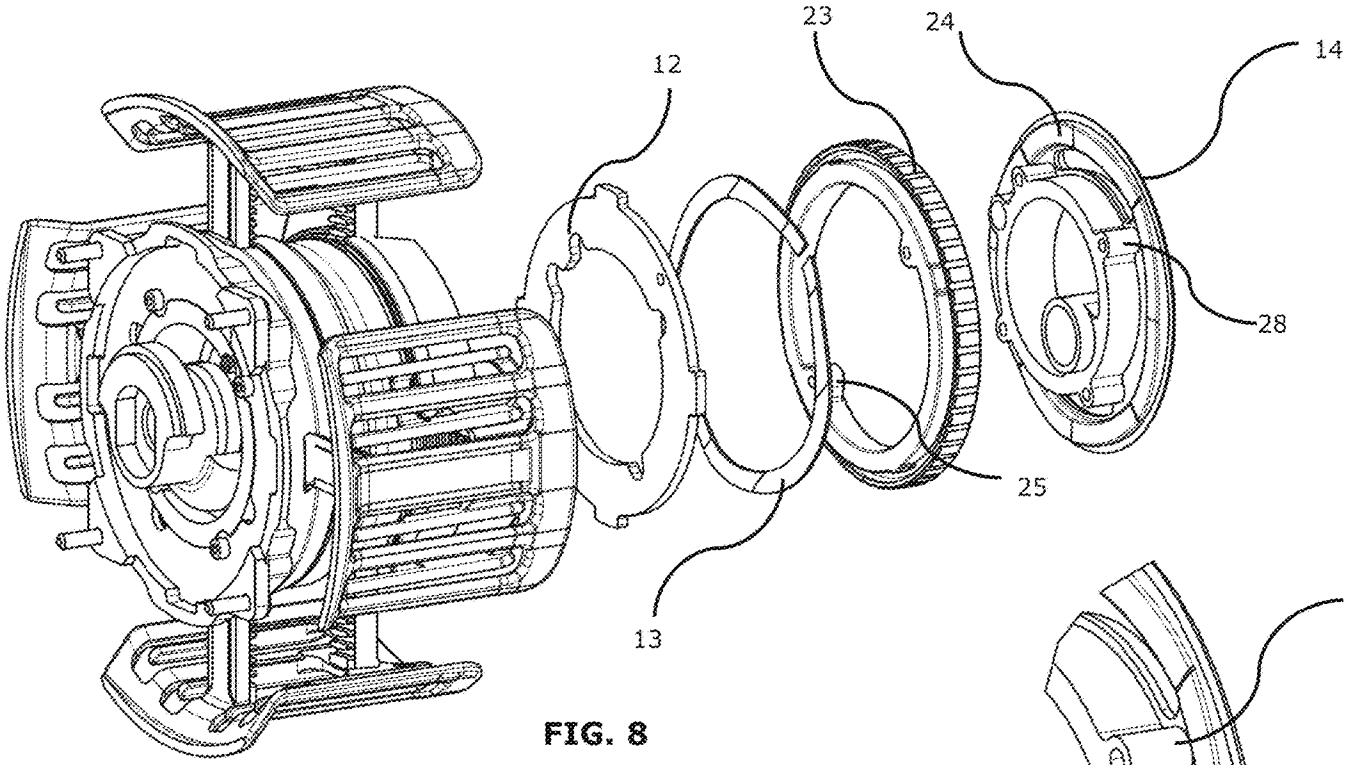
FIG. 8 is a view similar to FIG. 7 which illustrates the same winding area of the weft feeder as in FIG. 7, from an opposite point of view.

A preferred configuration of these additional locking elements in accordance with the second embodiment of the invention is schematically illustrated in FIGS. 6 to 8 in relation to the moving sectors 7. A completely similar configuration is naturally also possible for the fixed sectors 5, as will be explained in more detail below, even if the application of the locking elements to the moving sectors 7 is preferred, since said moving sectors 7 are more immediately accessible being positioned outside the winding group W. In any case, it is sufficient that the locking elements are applied to the moving sectors 7 or to the fixed sectors 5 for both sectors to remain perfectly locked in the set position, since the fixed sectors 5 and the moving sectors 7 are in any case always kept mutually integral by the adjustment group 3 and, specifically, by the internal sleeve 22.

The structure of the tilting body 2 is completely identical to that described above with reference to the first embodiment and therefore it includes a tilting spring 13, such as a wave spring or a cup spring, which keeps the moving sectors 7 pressed against their respective seats through the interposition of a flat and rigid tilting "shank-pressing" ring 12. The compressive force of the tilting spring 13 is predetermined by a tilting closing ring 14 of the tilting body 2 mounted at a predetermined distance from the tilting shank-pressing ring 12, to cause a desired preload of the tilting spring 13.

Figure 8A:
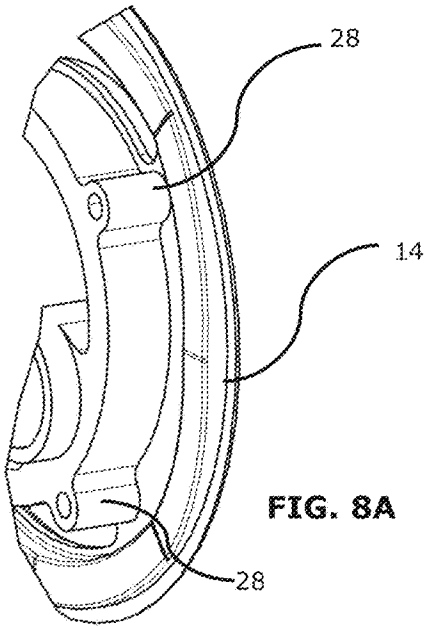
FIG. 8A is an enlarged partial view of the closing ring of FIG. 8.

According to the third feature of the invention, a tilting locking ring 23 is interposed between the tilting spring 13 and the tilting closing ring 14, mounted in the tilting body 2 in such a way as to be able to freely rotate with respect to both the tilting spring 13 and the tilting closing ring 14. The lateral surfaces of the tilting locking ring 23 and the tilting closing ring 14 that are in mutual contact include then contact surfaces 24 which are variously inclined (FIGS. 7A and 8A) with respect to a plane perpendicular to the weft feeder axis, so as to form a regular series of alternating concave and convex undulations; the thickness of the tilting locking ring 23 and that of the tilting closing ring 14, in the weft feeder axial direction, vary therefore along the circumference, due to said undulations, between minimum and maximum values.

The operations of quick locking/unlocking of the weft feeder moving sectors 7 in accordance with this second embodiment are therefore carried out by simply rotating the tilting locking ring 23 with respect to the tilting closing ring 14, in a controlled manner. During this rotation, in fact, the opposing contact surfaces 24 of the tilting locking ring 23 and the tilting closing ring 14 slide over each other, thus modifying the axial position of the tilting locking ring 23 and therefore the preload of the tilting spring 13.

In particular:

- when the facing contact surfaces 24 are superimposed in such a way that the concavities of one surface are arranged in correspondence with the convexities of the facing surface, the preload on the tilting spring 13 is at its minimum value, wherein adjustment of the diameter of the weft feeder sectors is possible, whilst ensuring that a minimum preload is maintained which is necessary for the moving sectors 7, and consequently the fixed sectors 5, to stably remain in their seats during standard operations of the weft feeder;
- when the facing contact surfaces 24 are instead superimposed in correspondence with their mutual convexities, the preload on the tilting spring 13 reaches its maximum value, or at the end the elastic capacity of the tilting spring 13 can be removed, thus creating a connection having a high clamping force, or at the end rigid, between the tilting closing ring 14 and the tilting shank-pressing ring 12.

Finally, bulges 25 are provided on the tilting locking ring 23, radially projecting towards the inside of the tilting locking ring 23. Said bulges 25 interact with corresponding end stops 28 (FIGS. 8 and 8A) formed in the inner portion of the tilting closing ring 14 to limit the rotation travel of the tilting locking ring 23, so as to guarantee with certainty the relative position of the two facing wavy contact surfaces 24 in the adjustment step of the weft feeder drum diameter (staggered coupling between the minimum height and maximum height portions of the opposing contact surfaces 24) and in the working phase of the weft feeder (coupling between the maximum height portions of said opposing contact surfaces 24).

On the bulges 25 of the tilting locking ring 23 grip holes 26 are finally provided, wherein special control levers (not illustrated) can be inserted, passing through arched access windows 27 formed in the tilting closing ring 14. Said control levers assist the operator in adjusting the angular position of the tilting locking ring 23, when the manual force alone applied on the knurled external circumference of the tilting locking ring 23 is not sufficient to switch the weft feeder from the adjustment position to the working position and vice versa.

By appropriately sizing the contact surfaces 24 in the weft feeder in accordance with the second embodiment of the invention, it is possible to precisely control both the force required to carry out the locking/unlocking operation by acting on the tilting locking ring 23, and the residual force acting on the sectors (the difference in height of the opposing contact surfaces 24 between the locked position and the unlocked position is in fact inversely proportional to the residual force acting on the sectors).

As already mentioned above, a completely similar construction can be envisaged to also provide the weft feeder fixed sectors 5 with a quick-action fastener—alternatively or additionally to the one described above for the moving sectors 7—by inserting a static locking ring (not illustrated) between the static spring 10 and the static closing ring 11 and providing both said static locking ring and the static closing ring 11 with wavy facing contact surfaces. The rotation of the aforementioned static locking ring which controls the locking/unlocking of the fixed sectors 5 can be controlled in different ways, for example by acting on the lateral surface of the static locking ring, or by means of gripping levers which run through the central cavity of the weft feeder and emerge from the closing ring 14 through a second pair of arched windows, transversely arranged with respect to the arched windows 27.

The weft feeder drum diameter adjustment, like the system already described in the previous paragraph, takes place by acting on the pinion 4 of the adjustment group 3.

In a weft feeder according to this second embodiment, the quick-tensioning fasteners are normally kept in the unlocked position, and the weft feeder can therefore operate exactly like a weft feeder according to the first embodiment of the invention. However, in case of need—for example for particularly heavy-duty weaving operations or in the event of wear or malfunctions that make it critical to maintain a stable position of the fixed sectors 5 and the moving sectors 7—the quick-tensioning fasteners described above can be very simply and quickly activated to stably lock the fixed sectors 5 and the moving sectors 7 in the desired working position.

From the above description, it is evident how the present invention has fully achieved all the intended objects. However, it is understood that the invention should not be considered as limited to the specific arrangements illustrated above, which are only exemplary embodiments thereof, but that different variants are possible, all within the reach of a person skilled in the art, without thereby departing from the scope of protection of the invention itself, which is only defined by the following claims.

REFERENCE LIST

A—hollow shaft
C—base body

D—drum
F—floating magnet-cup
G—coiler
M—electric motor
P—coiler channel
S—static magnet-cup
W—winding group
1—static body
2—tilting body
3—adjustment group
4—adjustment pinion
5—fixed sectors
5*f*—fixed-sector windows
5*g*—support shanks of the fixed sectors
6—static support disk
7—moving sectors
7*d*—fingers of the moving sectors
7*g*—support shanks of the moving sectors
8—tilting support disk
9—static shank-pressing ring
10—static spring
11—static closing ring
12—tilting shank-pressing ring
13—tilting spring
14—tilting closing ring
15—rolling bearing
16—reverse button
17—static adjustment ring
18—tilting adjustment ring
19—external sleeve
20—static disk-guide
21—tilting disk-guide
22—internal sleeve
23—tilting locking ring
24—inclined contact surfaces
25—bulges
26—grip holes
27—access windows
28—end stops

The invention claimed is:

1. A weft feeder for weaving looms with spaced thread coils and adjustable-diameter drum (D), wherein said drum (D) is formed of several fixed sectors (5), each provided with respective support shanks (5*g*) housed in respective seats formed in a static support disk (6), coaxial to a drive shaft (A) of the weft feeder, and wherein the spacing of said spaced coils on the drum (D) is caused by oscillatory and tilting movement of several moving sectors (7), each provided with respective support shanks (7*g*) housed in respective seats formed in a tilting support disk (8), eccentric and skew with respect to said drive shaft (A) of the weft feeder, and wherein elastic elements which exert a compressive force on said shanks (5*g*, 7*g*) are provided, to keep said fixed sectors (5) and said moving sectors (7) in a position of stable engagement within their respective seats, wherein the fixed sectors (5) and the moving sectors (7) are each provided with a single support shank (5*g*, 7*g*) having a general shape of a trapezoidal right prism, housed in a respective seat consisting of a cavity having a congruent trapezoidal shape, at least to a limited extent of its converging side walls, and wherein said elastic elements exert a compressive force on the major base of said support shank having a general shape of a trapezoidal right prism.

2. The weft feeder for weaving looms according to claim 1, wherein said support shanks (5*g*, 7*g*) of the fixed sectors (5) and the moving sectors (7) are in a shape of an isosceles trapezoidal right prism.

3. The weft feeder for weaving looms according to claim 1, wherein minor bases of said support shanks (5*g*, 7*g*) in the shape of a trapezoidal right prism include elements for guiding their longitudinal movement and regulating their position within their respective seats.

4. The weft feeder for weaving looms according to claim 1, wherein said compressive force is:

a. greater than a minimum clamping force required to keep an adjustment position of the support shanks (5*g*, 7*g*) unchanged, in normal operation of the weft feeder, and b. less than a maximum clamping force still allowing said support shanks (5*g*, 7*g*) to slide within their respective seats, in an operation to adjust the position of said fixed sectors (5) and moving sectors (7).

5. The weft feeder for weaving looms according to claim 1, further including quick-tensioning fasteners, bistable between a locked position and an unlocked position, which modify the compressive force exerted by said elastic elements on the support shanks (5*g*, 7*g*).

6. The weft feeder for weaving looms according to claim 5, wherein said modified compressive force:

a. in the locked position is greater than the minimum clamping force required to keep the adjustment position of said support shanks (5*g*, 7*g*) unchanged, under every operating condition of the weft feeder, and b. in the unlocked position is less than the maximum clamping force still allowing said support shanks (5*g*, 7*g*) to slide within their respective seats, in an operation to adjust the position of the fixed and moving sectors (5, 7).

7. The weft feeder for weaving looms according to claim 1, wherein said elastic elements include wave springs or cup springs (10, 13) acting on said support shanks (5*g*, 7*g*) of the fixed sectors (5) and the moving sectors (7) under a certain preload imposed by a closing ring (11, 14).

8. The weft feeder for weaving looms according to claim 7, further including a flat and rigid shank-pressing ring (9, 12), interposed between said elastic elements (10, 13) and said support shanks (5*g*, 7*g*) of the fixed sectors (5) and the moving sectors (7).

9. The weft feeder for weaving looms according to claim 5, wherein said quick-tensioning fasteners include a locking ring (23) interposed between said elastic elements (10, 13) and said closing ring (11, 14), and free to rotate therebetween, the opposing contact surfaces of the locking ring (23) and the closing ring (11, 14) being wavy contact surfaces (24) which cooperate for changing the axial position of the locking ring (23) during its rotation, between a position further away and a position closer to the closing ring (11, 14) and thereby varying the preload on the elastic elements (10, 13).

10. The weft feeder for weaving looms according to claim 9, wherein said locking ring (23) is provided with bulges (25) which determine limit positions of its rotation against corresponding end stops (28) formed in said closing ring (11, 14).

11. The weft feeder for weaving looms according to claim 10, wherein said bulges (25) are provided with grip holes (26) for engagement of control levers.

* * * * *